US008367592B2

(12) United States Patent
Kato et al.

(10) Patent No.: US 8,367,592 B2
(45) Date of Patent: Feb. 5, 2013

(54) LUBRICANT FOR METALLIC MATERIAL WORKING AND A METHOD OF PRESS WORKING A METALLIC MATERIAL

(75) Inventors: Mami Kato, Kariya (JP); Masami Sakakibara, Kariya (JP); Teruo Fukaya, Kariya (JP); Yoshio Miyasaka, Nagoya (JP)

(73) Assignee: Toyota Boshoku Kabushiki Kaisha, Aichi (JP)

( * ) Notice: Subject to any disclaimer, the term of this patent is extended or adjusted under 35 U.S.C. 154(b) by 571 days.

(21) Appl. No.: 11/817,480

(22) PCT Filed: Mar. 13, 2006

(86) PCT No.: PCT/JP2006/305334

§ 371 (c)(1),
(2), (4) Date: Aug. 30, 2007

(87) PCT Pub. No.: WO2006/095931

PCT Pub. Date: Sep. 14, 2006

(65) Prior Publication Data

US 2009/0011965 A1 Jan. 8, 2009

(30) Foreign Application Priority Data

Mar. 11, 2005 (JP) ..... 2005-069040
Nov. 22, 2005 (JP) ..... 2005-336999

(51) Int. Cl.
*C10M 141/10* (2006.01)
*B21B 45/02* (2006.01)

(52) U.S. Cl. ..... 508/371; 508/372; 508/485; 508/569; 72/42

(58) Field of Classification Search ..... 508/371, 508/375, 365; 72/42, 60
See application file for complete search history.

(56) References Cited

U.S. PATENT DOCUMENTS

| | | | | |
|---|---|---|---|---|
| 3,856,686 | A * | 12/1974 | Sato et al. | 508/112 |
| 4,659,488 | A | 4/1987 | Vinci et al. | |
| 5,616,816 | A | 4/1997 | Burjes et al. | |
| 5,716,913 | A * | 2/1998 | Yamamoto et al. | 508/365 |
| 6,002,051 | A | 12/1999 | Burjes et al. | |
| 6,187,726 | B1 * | 2/2001 | Nalesnik et al. | 508/552 |
| 7,284,525 | B2 * | 10/2007 | Nishimura et al. | 123/193.6 |
| 2004/0156995 | A1 * | 8/2004 | Komiyama et al. | 427/376.2 |
| 2005/0070444 | A1 * | 3/2005 | Shaw et al. | 508/110 |
| 2008/0070444 | A1 * | 3/2008 | Blasko et al. | 439/620.01 |

FOREIGN PATENT DOCUMENTS

| | | |
|---|---|---|
| JP | 8-20790 | 1/1996 |
| JP | 9-111278 | 4/1997 |
| JP | 2641203 | 5/1997 |
| JP | 10-88170 | 4/1998 |
| JP | 2000-73083 | 3/2000 |
| JP | 2001-49279 | 2/2001 |
| JP | 2002-105476 | 4/2002 |
| JP | 2002-155293 | 5/2002 |
| JP | 2003-213284 | 7/2003 |
| JP | 2003-253287 | 9/2003 |
| JP | 3501238 | 3/2004 |

OTHER PUBLICATIONS

An English language abstract JP 2001-49279.
An English language abstract of JP 8020790 A, Jan. 23, 1996 (provided by esp@cenet).
An English language abstract JP3501238.
An English language abstract JP 2002-155293.
An English language abstract JP8-20790.
An English language abstract JP 10-88170.
An English language abstract of JP 2002-105476.
An English language abstract JP 2003-253287.
An English language abstract JP 2003-213284.
An English language abstract JP 9-111278.
An English language abstract JP 2000-73083.
Tribiology Library, 6th edition, Cutting Oil and Grinding Oil Agent, Saiwai Shobo, Jun. 10, 1982.
An English language abstract of Tribology Library, 6th edition, Cutting Oil and Grinding Oil Agent, Saiwai Shobo, Jun. 10, 1982.
Additives for Petroleum products, Saiwai Shobo, Aug. 10, 1974, p. 201-207.
An English language abstract of Additives for Petroleum products, Saiwai Shobo, Aug. 10, 1974, p. 201-207.

* cited by examiner

*Primary Examiner* — Ellen Mcavoy
*Assistant Examiner* — Latosha Hines
(74) *Attorney, Agent, or Firm* — Greenblum & Bernstein, P.L.C.

(57) ABSTRACT

To provide a lubricant for metallic material working and a method of press working a metallic material that makes it possible to improve the working accuracy of a press worked product and prolong the life of the die assembly beyond prior levels of life. [Solution] A lubricant for metallic material working comprises a mixture of a sulfur-based extreme pressure agent, an organic zinc compound, a calcium-based additive, and an ester compound, with lubricant base oil. The sulfur-based extreme pressure agent has a sulfur content of 5% by weight or higher based on the total weight of the lubricant. The organic zinc compound has a zinc content of 0.5% by weight or higher based on the total weight of the lubricant. The calcium-based additive has a calcium content of 0.5% by weight or higher based on the total weight of the lubricant. And the ester compound occupies a content of 1.0% by weight or higher based on the total weight of the lubricant. Additionally, the solution includes a method of press working a metallic material that employs such a lubricant.

2 Claims, No Drawings

LUBRICANT FOR METALLIC MATERIAL WORKING AND A METHOD OF PRESS WORKING A METALLIC MATERIAL

TECHNICAL FIELD

This invention relates to a lubricant for metallic material working and a method of press working a metallic material.

Background Art

Various methods, such as punching, half-blanking, bending, and burring, are known as methods of press working a metallic material. When a metallic material is press worked, a lubricant is fed between the metallic material (i.e., the material to be worked) and a die assembly. The lubricant prevents the generation of heat due to friction between the metallic material and the die assembly and prevents the formation of burrs or the like on a worked surface. The feeding of the lubricant is also intended for improving the working accuracy of a worked product and prolonging the life of the die assembly, including a die and a punch.

A chlorine-based lubricant is often used as a lubricant when a metallic material is press worked. It has, however, been pointed out that a chlorine-based lubricant has a problem of rusting the material to be worked or the die assembly, as its chlorine-based additive component is decomposed during the working or with the passage of time. It has also been pointed out that the chlorine-based lubricant has a problem of producing a harmful substance at a time of incineration, or corroding or damaging the incinerator. Accordingly, there is desired a press working lubricant that is free from any chlorine-based substances and yet is comparable or superior to any of the chlorine-based lubricants in seizure resistance and lubricating properties.

What is described in Patent Literature 1, for example, is known as a lubricant that does not contain any chlorine-based additives. However, the lubricant described in Patent Literature 1 is a lubricant used for cutting, and the lubricant is not satisfactory in seizure resistance or lubricating properties. Additionally, the lubricant is unsatisfactory in performance for use as a lubricant for press working a metallic material. In particular, the lubricant is unsatisfactory for precision shearing.

Patent Literature 2 and 3 disclose cutting oil compositions containing an overbased metal sulfonate, a sulfur-based extreme pressure agent, etc. However, these lubricants have the problem of being unable to exhibit any satisfactory lubricating properties for any press workings having a high level of difficulty, such as precision shearing. However, these lubricants may exhibit good lubricating properties for common metalworking.

[Patent Literature 1] JP 2002-155293 A

[Patent Literature 2] JP 2,641,203 B2

[Patent Literature 3] JP 8-20790 A

DISCLOSURE OF THE INVENTION

Problems to be Solved by the Invention

It is, therefore, an object of the present invention to provide a lubricant for metallic material working and a method of press working a metallic material that makes it possible to reduce the friction between a metallic material and a die assembly, improve the working accuracy of a press worked product, and prolong the life of the die assembly beyond prior levels of life.

Means for Solving the Problems

We, the inventors of the present invention, have paid attention to two issues, a lubricant used for press working a metallic material and a method for the surface treatment of a die assembly used therewith. As a result, we have found that the use of a lubricant having a specific composition and a die assembly subjected to a surface treatment under specific conditions makes it possible to improve the working accuracy of a worked product over prior levels of accuracy in addition to prolonging the life of the die assembly. We have completed the inventions as set forth below.

A first invention is a lubricant for metallic material working comprising a mixture of a sulfur-based extreme pressure agent, an organic zinc compound, a calcium-based additive, and an ester compound, with lubricant base oil. The sulfur-based extreme pressure agent has a sulfur content of 5% by weight or higher based on the total weight of the lubricant. The organic zinc compound has a zinc content of 0.5% by weight or higher based on the total weight of the lubricant. The calcium-based additive has a calcium content of 0.5% by weight or higher based on the total weight of the lubricant. And the ester compound occupies a content of 1.0% by weight or higher based on the total weight of the lubricant.

A second invention is a method of press working a metallic material, by using a die assembly subjected to a surface treatment, after feeding a lubricant according to the first invention between the metallic material and the die assembly.

The surface treatment is a treatment comprising the blasting of fine particles of high-speed tool steel having an average diameter of from 30 to 80 μm (both inclusive) against the surface of the die assembly at a jet velocity of from 130 to 170 m/s (both inclusive). Then the blasting of fine particles of a ceramic material having an average diameter of from 40 to 70 μm (both inclusive) against the surface of the die assembly at a jet velocity of from 130 to 170 M/s (both inclusive).

A third invention is a method of press working a metallic material according to the second invention, wherein the die assembly, whose surface is subjected to the surface treatment and further subjected to a titanium nitride coating treatment, is used for press working the metallic material.

ADVANTAGES OF THE INVENTION

The present invention makes it possible in the press working of a metallic material to reduce friction between the metallic material and a die assembly, to improve the working accuracy of a press worked product, and to prolong the life of the die assembly beyond prior levels of life.

BEST MODE OF CARRYING OUT THE INVENTION

The lubricant for metallic material working according to the present invention is a lubricant for metallic material working comprising a mixture of a sulfur-based extreme pressure agent, an organic zinc compound, a calcium-based additive, and an ester compound, with lubricant base oil. The sulfur-based extreme pressure agent has a sulfur content of 5% by weight or higher based on the total weight of the lubricant. The organic zinc compound has a zinc content of 0.5% by weight or higher based on the total weight of the lubricant. The calcium-based additive has a calcium content of 0.5% by weight or higher based on the total weight of the lubricant. And the ester compound occupies a content of 1.0% by weight or higher based on the total weight of the lubricant. The phrase "based on the total weight of the lubricant" means the percentage by weight of the total weight of the lubricant taken to be 100.

The method of press working a metallic material according to the present invention is a method of press working a metallic material, by using a die assembly subjected to surface treatment, after feeding a lubricant according to the first invention between the metallic material and the die assembly.

The surface treatment is a treatment comprising the blasting of fine particles of high-speed tool steel having an average diameter of from 30 to 80 μm (both inclusive) against the surface of the die assembly at a jet velocity of from 130 to 170 m/s (both inclusive). Then the blasting of fine particles of a ceramic material having an average diameter of from 40 to 70 μm (both inclusive) against the surface of the die assembly at a jet velocity of from 130 to 170 m/s (both inclusive).

A description will now be made of the lubricant for metallic material working according to the present invention. After which, a description of a method for the surface treatment of a die assembly and the method of press working a metallic material will be made.

[Lubricant]

The lubricant according to the present invention is a lubricant for metallic material working comprising a mixture of a sulfur-based extreme pressure agent, an organic zinc compound, a calcium-based additive and an ester compound, with lubricant base oil. The lubricant according to the present invention is free from any chlorine-based additives and yet is comparable or superior to any chlorine-based lubricants in seizure resistance and lubricating properties.

At least one kind of oil selected from among mineral or synthetic oils and fats or oils can be used as the lubricant base oil for the lubricant according to the present invention. There is no particular limitation as to the mineral or synthetic oils and fats or oils if they are generally used as base oils. The lubricant base oil preferably has a dynamic viscosity at 40° C. in the range from 1 to 1000 $mm^2/s$ and more preferably in the range from 5 to 100 $mm^2/s$.

Various kinds of such mineral and synthetic oils and oils or fats are available. An appropriate one may be selected in accordance with the use, etc.

As regarding mineral oils, it is possible to use, for example, mineral oils that are refined by a customary method in a process for lubricant manufacture by the petroleum refining industry. More specific examples are obtained when lubricant residues generated by the atmospheric and vacuum distillation of crude oil are refined by one or more methods of treatment, such as solvent treatment for the removal of bitumen, solvent extraction, hydrocracking, solvent dewaxing, catalytic dewaxing, hydrorefining, sulfuric acid cleansing or white clay treatment.

As regarding synthetic oils, it is possible to mention, for example, poly α-olefins, α-olefin copolymers, polybutenes, alkylbenzenes, polyoxyalkylene glycols, polyoxyalkylene glycol ethers, and silicone oils.

As specific examples of fats and oils, it is possible to mention beef tallow, lard, soybean oil, rapeseed oil, rice bran oil, coconut oil, palm oil, palm kernel oil and hydrides thereof.

The lubricant according to the present invention may contain either only one of the base oils mentioned above or a mixture of two or more base oils.

A description will now be made of the four components mixed with the lubricant base oil, i.e. (a) a sulfur-based extreme pressure agent, (b) an organic zinc compound, (c) a calcium-based additive, and (d) an ester compound.

(a) Sulfur-Based Extreme Pressure Agent:

It is possible to use as a sulfur-based extreme pressure agent, one having a sulfur atom and exhibiting an extreme pressure effect. It is possible to consider sulfurized fats or oils, sulfurized fatty acids, sulfurized esters, sulfurized olefins, polysulfides, thiocarbamates, and sulfurized mineral oils, as specific examples of sulfur-based extreme pressure agents. Reacting sulfur and fats or oils (lard, whale oil, vegetable oil, fish oil, etc.) obtains the sulfurized fats or oils. Specific examples thereof are sulfurized lard, sulfurized rapeseed oil, sulfurized castor oil, and sulfurized soybean oil. Sulfurized oleic acid can be considered as an example of sulfurized fatty acids, and sulfurized methyl oleate and sulfurized rice bran fatty acid octyl esters as examples of sulfurized esters.

Sulfurized olefins can be obtained by reacting olefins having 2 to 15 carbon atoms or any of dimers to tetramers thereof with a sulfurizing agent, such as sulfur or sulfur chloride.

Specific examples of polysulfides are dibenzyl polysulfide, di-tert-nonyl polysulfide, didodecyl polysulfide, di-tert-butyl polysulfide, dioctyl polysulfide, diphenyl polysulfide, and dicyclohexyl polysulfide.

Specific examples of thiocarbamates are zinc thiocarbamate, dilaurylthiodipropionate, and distearylthiodipropionate.

Sulfurized mineral oils are mineral oils in which simple sulfur is dissolved. There is no particular limitation as to the mineral oils in which simple sulfur is dissolved, but it is possible to use mineral oils, considered before as examples of lubricant base oils, in the description of base oils.

The present invention may employ either, only one of the sulfur-based extreme pressure agents mentioned at (a) above, or a combination of two or more thereof.

The sulfur-based extreme pressure agent preferably has a sulfur content of from 1 to 50% by weight based on the total weight of the lubricant. It is more preferably from 5 to 30% by weight. No smaller amount is desirable since the lubricant may fail to maintain its lubricating properties. Additionally, no larger amount is desirable since it is unrealistic to expect any correspondingly improved results. The term "sulfur content" as used herein means the amount of sulfur atoms contained in the sulfur-based extreme pressure agent. The "sulfur content" as defined can be obtained by calculations based on the atomic weight of sulfur.

(b) Organic Zinc Compound:

It is possible to consider zinc dialkyldithiophosphate (hereinafter referred to as ZnDTP) and zinc dialkyldithiocarbamate (hereinafter referred to as ZnDTC) as preferred organic zinc compounds. The alkyl groups in each of ZnDTP and ZnDTC may be the same or different. Referring to the structural formula of ZnDTP, the two alkyl groups bonded to phosphorus atoms by oxygen atoms may be the same or different. Referring to the structural formula of ZnDTC, the two alkyl groups bonded to nitrogen atoms may be the same or different. The alkyl groups of ZnDTP and ZnDTC are preferably alkyl or aryl groups having three or more carbon atoms.

The present invention may employ either, only one of the organic zinc compounds mentioned at (b) above, or a combination of two or more thereof.

The organic zinc compound preferably has zinc content of from 0.01 to 10% by weight based on the total weight of the lubricant. It is more preferably from 0.5 to 5% by weight. No smaller amount is desirable since the lubricant may fail to maintain its lubricating properties. Additionally, no larger amount is desirable since it is unrealistic to expect any correspondingly improved results. The term "zinc content" as used herein means the amount of zinc atoms contained in the organic zinc compound. The "zinc content" as defined can be obtained by calculations based on the atomic weight of zinc.

(c) Calcium-Based Additive:

As preferred calcium-based additives, it is possible to consider calcium sulfonate, calcium salicylate and calcium phenate. Calcium sulfonate is, among others, preferred for its dynamic viscosity and price. Basic calcium sulfonate is more preferable. Basic calcium sulfonate having a base value of 300 mg KOH/g or higher is still more preferable.

The present invention may employ either, only one of the calcium-based additives mentioned at (c) above, or a combination of two or more thereof.

The calcium-based additive preferably has calcium content of from 0.01 to 10% by weight based on the total weight of the lubricant. It is more preferably from 0.5 to 5% by weight. No smaller amount is desirable since the lubricant may fail to maintain its lubricating properties. Additionally, no larger amount is desirable since it is unrealistic to expect any correspondingly improved results. The term "calcium content" as used herein means the amount of calcium atoms contained in the calcium-based additive. The "calcium content" as defined can be obtained by calculations based on the atomic weight of calcium.

(d) Ester Compound:

It is possible to consider polyol esters and complex esters as preferred ester compounds. Only one of them, or two or more of them may be mixed with the lubricant base oil.

The polyol esters are the polyol esters formed from aliphatic polyhydric alcohols and straight or branched fatty acids. It is possible to consider as the aliphatic polyhydric alcohols forming the polyol ester, for example, neopentyl glycol, trimethylolpropane, ditrimethylolpropane, trimethylolethane, ditrimethylolethane, pentaerythritol, dipentaerythritol, and tripentaerythritol. It is also possible to use partial esters formed from those aliphatic polyhydric alcohols and straight or branched fatty acids.

The complex esters are the complex esters formed from aliphatic polyhydric alcohols, straight or branched fatty acids, and straight or branched aliphatic dibasic acids. It is possible to consider as the aliphatic polyhydric alcohols, for example, trimethylolpropane, trimethylolethane, pentaerythritol, and dipentaerythritol. As the fatty acids, it is possible to consider, for example, aliphatic carboxylic acids, such as heptadecylic acid, stearic acid, nonadecanoic acid, arachic acid, behenic acid, and lignoceric acid. As the dibasic acids, it is possible to consider, for example, succinic acid, adipic acid, pemeric acid, suberic acid, azelaic acid, sebasic acid, undecanedioic acid, dodecanedioic acid, carboxyoctadecanoic acid, carboxymethyloctadecanoic acid, and docosanedioic acid.

The ester compound preferably has a dynamic viscosity at 100° C. in the range from 100 to 10,000 $mm^2/s$, and more preferably from 1,000 to 5,000 $mm^2/s$.

The ester compound preferably occupies a content of from 0.5 to 40% by weight based on the total weight of the lubricant. It is more preferably from 1.0 to 20% by weight. If the ester compound has a lower content, the lubricant tends to have a lower level of seizure resistance. In addition, if the ester compound has a higher content, the lubricant becomes too viscous to be easily handled.

Mixing the above components (a) to (d) with the lubricant base oil can produce the lubricant according to the present invention. Additionally, the lubricant may further contain various kinds of known additives, etc., as properly selected to the extent of not interfering with the object of the present invention.

As the known additives, it is possible to consider a rust preventive, an oxidation inhibitor, a corrosion inhibitor, a coloring agent, a defoaming agent, a perfume, etc. As the rust preventive, it is possible to consider a calcium-based, barium-based, or wax-based rust preventive, etc. As the oxidation inhibitor, it is possible to consider an amine compound, a phenolic compound, etc. As the corrosion inhibitor, it is possible to consider benzotriazole, tolyltriazole, mercaptobenzothiazole, etc. As the coloring agent, it is possible to consider a dye, a pigment, etc.

[Surface Treatment]

A description will now be made of a method for the surface treatment of a die assembly.

The method of press working a metallic material according to the present invention relies on fine particles blasted against the surface of a press working die assembly for increasing the strength of the die assembly.

There is no particular limitation as to the type of device that is used for the blasting of fine particles against the surface of the die assembly, but a gravity type blasting device can, for example, be used.

Two kinds of fine particles are blasted against the surface of the die assembly according to the present invention, (A) fine particles of high-speed tool steel having an average diameter of from 30 to 80 μm, and (B) fine particles of a ceramic material having an average diameter of from 40 to 70 μm. These particles preferably have a substantially spherical shape. The term "average diameter" of fine particles as used herein means the diameter that divides the weight of the powder in two when it is sieved, or the median diameter (d50).

The fine particles of high-speed tool steel described at (A) above are preferably fine particles of high-speed tool steel corresponding to SKH as specified by JIS.

Moreover, the fine particles of high-speed tool steel described at (A) above are preferably higher in hardness than the die assembly against which they are blasted.

The fine particles of a ceramic material described at (B) above are preferably fine particles of titanium oxide or glass. It is also possible to use fine particles of any other ceramic material, such as alumina, zirconia, titania, or silica. Fine particles of titanium oxide are, among others, preferred.

Moreover, the fine particles of a ceramic material described at (B) above are preferably higher in hardness than the die assembly against which they are blasted.

The blasting of fine particles against the surface of the die assembly cycles rapid heating and cooling of the surface of the die assembly at a temperature equal to or higher than its $A_3$ transformation point. This consequently makes it possible to simultaneously obtain results including the work hardening of the surface accompanying the generation of compressive residual stress and an increase in fatigue strength. The hardening of a metal surface via a surface treatment is itself a craft that is already known from JP-B-Hei-2-17607, etc.

Numerous fine concavities are formed in the surface of the die assembly by the surface treatment. These concavities are very small concavities and may serve as "oil reservoirs" for retaining the lubricant. Consequently, when a metallic material is press worked by the die assembly, the lubricant is more easily held on the surface of the die assembly. Running out of oil is prevented and friction from the surface of the die assembly can be drastically reduced. It is preferable to use fine particles having a spherical or substantially spherical shape in order to reduce the friction of the surface of the die assembly. When fine particles having a spherical shape are used, concavities having an arcuate section are formed in the surface of the die assembly and enable the lubricant to exhibit surface tension more effectively. Thereby, the lubricant is more easily held on the surface of the die assembly.

[Method of Press Working a Metallic Material]

The method of press working a metallic material according to the present invention is characterized firstly by using a "lubricant" as previously described and secondly by using a die assembly subjected to a "surface treatment" as previously described. The combination of the "lubricant" having the previously described specific composition and the die assembly subjected to the previously described specific "surface treatment" produces better results than when they are separately employed.

The surface hardness of the die assembly is further improved by a titanium nitride coating treatment (TiN coating treatment) of the surface following the blasting of fine particles thereagainst. This makes it possible to prolong the service life of the die assembly. There is no particular limitation as to the method for titanium nitride coating, but any of various known coating methods can be employed. For example, PVD (physical vapor deposition) can be employed to perform titanium nitride coating treatments.

The method of press working a metallic material according to the present invention produces particularly good results when the method is applied to shearing, such as punching or boring, and press working, such as fine blanking (FB).

The method of press working a metallic material according to the present invention is applicable to the press working of any metallic material. For example, the present invention can be employed for press working stainless steel, alloy steel, carbon steel, or an aluminum alloy. The present invention produces good results particularly when press working carbon or alloy steel.

The lubricant for metallic material working according to the present invention makes it possible to avoid the problem of rusting of any product or die assembly, since the lubricant does not contain chlorine. The lubricant for metallic material working according to the present invention can be employed without being limited by the kind of metal as a working material. For example, the lubricant can be used when stainless steel, alloy steel, carbon steel, or an aluminum alloy is press worked. However, the lubricant for metallic material working according to the present invention produces good results particularly when carbon or alloy steel is press worked.

The method of press working a metallic material according to the present invention improves the accuracy of the press working of a metallic material. There is no particular limitation as to the method of feeding the lubricant at the time of press working, but it is possible to adopt a method such as the roller coating of the surface of the material to be worked or the spray coating of the surface of the material to be worked. It is also possible to not apply the lubricant to the surface of the material to be worked, but instead to the surface of the die assembly as a press-working tool. The feeding of the lubricant between the metallic material and the die assembly makes it possible to prevent or inhibit any rusting and damaging of the die assembly and thereby prolong the service life of the die assembly. It also makes it possible to reduce the friction between the metallic material and the die assembly and thereby prevent the formation of burrs, etc. on a press worked surface and improve the accuracy of press working of the metallic material.

EXAMPLES

A description will now be made of specific examples of the lubricant for metallic material working and the method of press working a metallic material according to the present invention. However, the present invention is not limited to the following examples.

Lubricants 1 to 8, each having the composition shown in Table 1, were first prepared by using base oils and various kinds of additives, as shown below.

(Base Oils)

Base oil 1: Paraffinic mineral oil (having a dynamic viscosity of 450 $mm^2/s$ at 40° C.)

Base oil 2: Naphthenic mineral oil (having a dynamic viscosity of 46 $mm^2/s$ at 40° C.)

Base oil 3: Paraffinic mineral oil (having a dynamic viscosity of 10 $mm^2/s$ at 40° C.)

(a) Sulfur-Based Extreme Pressure Agent a1: Polysulfide (having a sulfur content of 37% by weight)

a2: Polysulfide (having a sulfur content of 32% by weight)

a3: Sulfurized fat or oil (having a sulfur content of 15% by weight)

a4: Sulfurized fat or oil (having a sulfur content of 11% by weight)

(b) Organic Zinc Compound b1: ZnDTP (having a zinc content of 9% by weight and a sulfur content of 16% by mass)

b2: ZnDTP (having a zinc content of 5% by weight and a sulfur content of 11% by mass)

b3: ZnDTP (having a zinc content of 9% by weight and a sulfur content of 15% by mass)

(c) Calcium-Based Additive c1: Calcium sulfonate (having a calcium content of 15% by weight)

(d) Ester Compound d1: Polyol ester and/or complex ester (Other Components)

e1: Chlorinated paraffin (having a chlorine content of 50% by weight)

e2: Vegetable fat or oil e3: Synthetic oil

Lubricants 1 to 8, each prepared to have the composition shown in Table 1, were evaluated for their performance by using the apparatus and method described below.

(Apparatus for Evaluation Test)

Press machine: AIDA link press VL-6000 (having a production rate of 70 spm)

Material feeding distance: 23.5 mm

Material to be worked: SPH440 (a sheet having a width of 70 mm and a thickness of 4.6 mm)

Lubricant feeding method: Uniform coating by a resin roll of the surface of the material to be worked Material of punch 1: SKD11

Material of punch 2: SKD11 with TiN coating

Material of die: SKD11

(Method of Evaluation)

The resin roll uniformly fed each of lubricants 1 to 8, prepared to have the composition shown in Table 1, to the surface of the material to be worked. Two holes, each measuring 10 mm by 12 mm by 4.6 mm deep, were made simultaneously by the two kinds of punches. The press load required for punching was measured and the surface of each punch was visually examined after punching. Additionally, the sheared surface of each hole made by the punching was visually examined.

TABLE 1

| | Lubricant 1 | Lubricant 2 | Lubricant 3 | Lubricant 4 | Lubricant 5 | Lubricant 6 | Lubricant 7 | Lubricant 8 |
|---|---|---|---|---|---|---|---|---|
| Base oil 1 | 15 | | | | | | | |
| Base oil 2 | | | | 35 | | | | |
| Base oil 3 | | 25 | | | 30 | 40 | 30 | 20 |
| A1 | 70 | | | | | | | |
| A2 | | 15 | | | 5 | 20 | 5 | |
| A3 | | 15 | 40 | 30 | 20 | 15 | 10 | |
| A4 | | 15 | 60 | 10 | 10 | | 20 | |
| B1 | | | | 5 | 15 | 5 | 15 | |
| B2 | | 15 | | | | | | |
| B3 | | | | 10 | | | | |
| C1 | | | | 10 | 10 | 20 | 10 | |
| D1 | | | | | | | 10 | |
| E1 | | | | | | | | 70 |
| E2 | 15 | 15 | | | | | | 10 |
| E3 | | | | | 10 | | | |
| Sulfur (%) | 25 | 11 | 14 | 7 | 8 | 9.2 | 7.9 | |
| Zinc (%) | | 0.9 | | 1.0 | 1.3 | 0.5 | 1.3 | |
| Calcium (%) | | | | 1.1 | 1.5 | 3.0 | 1.5 | |
| Chlorine (%) | | | | | | | | 35 |
| Ester (%) | | | | | | | 10 | |
| Load (t) | 100 | 97 | 94 | 93 | 92 | 100 | 92 | 97 |
| Punch surface | Good | Good | Good | Good | Good | Good | Good | Good |
| Sheared surface | Good | Good | Good | Good | Good | Good | Good | Good |

Table 1 above shows the composition of each of the lubricants 1 to 8 on a part by weight basis. "Sulfur (%)" indicates the proportion of sulfur (sulfur atoms) in the sulfur-based extreme pressure agent (a) by weight percentage based on the total weight of the lubricant. "Zinc (%)" indicates the proportion of zinc (zinc atoms) in the organic zinc compound (b) by weight percentage based on the total weight of the lubricant. "Calcium (%)" indicates the proportion of calcium (calcium atoms) in the calcium-based additive (c) by weight percentage based on the total weight of the lubricant. "Ester (%)" indicates the proportion of the ester compound (d) by weight percentage based on the total weight of the lubricant.

As is obvious from the results shown in Table 1, after punching the punch surface was good when lubricant 7 was used. More specifically; no seizure or damage was found on the punch surface. Additionally, when the punch made of SKD11 and having TiN coating thereon was used, no separation or peeling of the coating was found. The sheared surfaces of the holes made with the punches were very good and the holes were found to have been formed accurately with the dimensions as intended and without any substantial burrs or shear drop formed around them. On the other hand, the use of lubricants 1 to 6 and 8 resulted in an increase in the press load required for punching, although the punch surfaces and the sheared surfaces of the holes on the whole were good.

The above results showed that the lubricant for metallic material working according to the present invention (lubricant 7) had a high seizure resistance level and a high lubricating property level.

A test was then conducted for estimating the service life of the die assembly under the conditions stated below.

(Apparatus for Evaluation Test)

Press machine: AIDA link press VL-6000 (having a production rate of 70 spm)

Material feeding distance: 23.5 mm

Material to be worked: SPH440 (a sheet having a width of 70 mm and a thickness of 4.6 mm)

Lubricant: "Lubricant 7" in table 1

Lubricant feeding method: A resin roll uniformly coating the surface of the material to be worked Material of punch 1: SKD11

Material of punch 2: SKD11 with TiN coating

Material of punch 3: SKD11 with TiAlN coating

Material of punch 4: SKD11 with TiCN coating

Material of die: SKD11

(Method of Evaluation)

The resin roll consistently applied the lubricant, having the composition shown as "Lubricant 7" in Table 1, to uniformly coat the surface of the material to be worked. Additionally, two holes each measuring 10 mm by 12 mm by 4.6 mm deep were simultaneously made by using punches 1 to 4. Measurements were made for the press load required for punching and the number of punching times at which point a punch failure occurred. The results are shown in Table 2 below.

TABLE 2

| | Punch 1 | Punch 2 | Punch 3 | Punch 4 |
|---|---|---|---|---|
| Load (t) | 90 | 91 | 92 | 89 |
| Sheared surface | Good | Good | Good | Good |
| Number of times of punching which caused punch failure | −9,000 | −10,000 | −2,000 | −8,000 |

As is obvious from the results shown in Table 2 above, the punch of SKD11 coated with TiN was found to have the longest service life of all of the samples.

A similar test was conducted by using a punch (die assembly) subjected to a surface treatment. More specifically, fine spherical particles of high-speed tool steel having an average diameter of 60 μm were blasted against the surface of a punch made of SKD11 at a jet velocity of from 130 to 170 m/s, and fine spherical particles of a ceramic material having an average diameter of 60 μm were then blasted against it at a jet velocity of from 130 to 170 m/s. The surface treatment was further followed by a titanium nitride coating treatment of the punch surface by PVD. The resulting punch is called "punch 5". Punch 5 was employed in a test for measuring the press load required for punching and the number of punching times until the occurrence of a punch failure. The results are shown in Table 3 below.

TABLE 3

| | Punch 5 |
|---|---|
| Load (t) | 89 |
| Sheared surface | Good |
| Number of times of punching which caused punch failure | −10,000 |

As is obvious from the results shown in Table 3, the die assembly of SKD11, subjected to titanium nitride coating treatment after a surface treatment (punch 5), was found to require a smaller press load for punching than the die assembly of SKD11 subjected simply to the titanium nitride coating treatment (punch 2).

The service life of the die assembly was then estimated in production facilities, as stated below. The results are shown in Table 4.

(Production Facilities)

Press machine: Fine Tool hydraulic press (having a production rate of 25 spm)

Material to be worked: SPH440 (a sheet having a width of 70 mm and a thickness of 4.6 mm)

Parts produced: Parts of a reclining device for an automobile seat

Lubricants used: Lubricant 7 in Table 1 above (according to the present invention)

Lubricant 8 in Table 1 above (Comparative Example)

Lubricant feeding method: A resin roll uniformly coating the surface of the material to be worked Punches used: Punch 5 (according to the present invention)

Punch 2 (Comparative Example)

TABLE 4

| Kind of punch | Punch 2 | Punch 5 | Punch 5 |
|---|---|---|---|
| Kind of lubricant | Lubricant 8 | Lubricant 8 | Lubricant 7 |
| Sheared surface | Good | Good | Good |
| Number of times of punching which caused punch failure | −13,000 | −80,000 | −100,000 |

As is obvious from the results shown in Table 4, the combination of punch 5 and lubricant 7 was found to generate a very good sheared surface on a press worked product. The combination of punch 5 and lubricant 7 was also found to realize a significantly prolonged service life for the punch by permitting approximately 100,000 punching cycles before the occurrence of a punch failure.

The test results confirmed that the use of a lubricant having a specific composition (lubricant 7) and a die assembly subjected to specific surface treatment (punch 5) makes it possible to improve the working accuracy of a press worked product. The test results also confirmed that the described method could prolong the life of the die assembly beyond prior levels of life.

The invention claimed is:

1. A method of press working a metallic material, by using a die assembly subjected to a surface treatment, after feeding a lubricant between the metallic material and the die assembly, the surface treatment being a treatment comprising a blasting of fine particles of high-speed tool steel having an average diameter of from 30 to 80 μm against the surface of the die assembly at a jet velocity of from 130 to 170 m/s, and then a blasting of fine particles of a ceramic material having an average diameter of from 40 to 70 μm against the surface of the die assembly at a jet velocity of from 130 to 170 m/s, wherein the lubricant comprises a mixture of a sulfur-based extreme pressure agent, an organic zinc compound, a calcium-based additive, and an ester compound, with a lubricant base oil, the lubricant being free from chlorine-based additives, wherein the sulfur-based extreme pressure agent comprises sulfurized fats or oil or a combination of sulfurized fats or oils and polysulfides and has a sulfur content of 5% to 8% by weight based on the total weight of the lubricant, the organic zinc compound comprises ZnDTP and comprises a zinc content of 0.5% to 1.3% by weight based on the total weight of the lubricant, the calcium-based additive comprises basic calcium sulfonate and has a calcium content of 0.5% to 1.5% by weight based on the total weight of the lubricant, the ester compound comprises at least one selected from the group consisting of polyol esters and complex esters and occupies a content of 1.0% by weight or higher based on the total weight of the lubricant, and the lubricant base oil comprises paraffinic mineral oils or naphthenic mineral oils.

2. A method of press working a metallic material as set forth in claim 1, wherein the die assembly, whose surface is subjected to the surface treatment and also subjected to a titanium nitride coating treatment, is used for press working the metallic material.

* * * * *